US009884321B2

(12) United States Patent
Huester et al.

(10) Patent No.: US 9,884,321 B2
(45) Date of Patent: Feb. 6, 2018

(54) LABORATORY DEVICE

(71) Applicant: C + P Moebelsysteme GmbH & Co. KG, Breidenbach (DE)

(72) Inventors: Tanja Huester, Hatzfeld-Reddighausen (DE); Tobias Walter, Dillenburg-Manderbach (DE); Juergen Wallbott, Lahnau-Atzbach (DE)

(73) Assignee: C + P Moebelsysteme GmbH & Co. KG, Breidenbach (DE)

( * ) Notice: Subject to any disclaimer, the term of this patent is extended or adjusted under 35 U.S.C. 154(b) by 0 days.

(21) Appl. No.: 15/125,297

(22) PCT Filed: Feb. 26, 2015

(86) PCT No.: PCT/EP2015/053969
§ 371 (c)(1),
(2) Date: Sep. 12, 2016

(87) PCT Pub. No.: WO2015/135754
PCT Pub. Date: Sep. 17, 2015

(65) Prior Publication Data

US 2017/0072401 A1 Mar. 16, 2017

(30) Foreign Application Priority Data

Mar. 13, 2014 (DE) ..... 10 2014 103 425

(51) Int. Cl.
*B01L 9/02* (2006.01)
*A47B 83/04* (2006.01)
(Continued)

(52) U.S. Cl.
CPC ..... *B01L 9/02* (2013.01); *A47B 3/00* (2013.01); *A47B 35/00* (2013.01); *A47B 46/00* (2013.01);
(Continued)

(58) Field of Classification Search
CPC ..... B01L 9/02; A47B 2037/005; A47B 46/00; A47B 46/005; A47B 83/001;
(Continued)

(56) References Cited

U.S. PATENT DOCUMENTS 260,703 A * 7/1882 Moore et al. ..... A47B 53/02 312/200
654,922 A * 7/1900 Schipkowsky ..... A47B 17/036 312/196

(Continued)

FOREIGN PATENT DOCUMENTS

| | | |
|---|---|---|
| DE | 94 04 456 | 5/1994 |
| EP | 2 422 648 | 2/2012 |
| WO | 99/66816 | 12/1999 |

*Primary Examiner* — Hanh V Tran
(74) *Attorney, Agent, or Firm* — Clark & Brody

(57) ABSTRACT

It is problematic that modern classrooms are often not so flexibly usable that said classrooms are suitable for lecture-style teaching and also for natural-science teaching with practical instructional content. Therefore, the invention relates to a laboratory device (1), comprising a cabinet (10), which has an internal cabinet space (11), wherein a laboratory bench (20) is supported at the cabinet (10) in such a way that the laboratory bench can be pivoted about an axis of rotation (A), and wherein the laboratory bench (20) is positioned in the cabinet space (11) in a first pivot position (P1) about the pivot axis (A) and is arranged at least partially outside of the cabinet space (11) in a second pivot position (P2) about the axis of rotation (A).

15 Claims, 10 Drawing Sheets

(51) Int. Cl.

| | |
|---|---|
| ***A47B 85/08*** | (2006.01) |
| ***A47B 3/00*** | (2006.01) |
| ***A47B 35/00*** | (2006.01) |
| ***A47B 46/00*** | (2006.01) |
| ***A47B 81/00*** | (2006.01) |
| ***A47B 83/00*** | (2006.01) |
| ***A47B 91/06*** | (2006.01) |
| ***B01L 1/00*** | (2006.01) |
| *A47B 37/00* | (2006.01) |

(52) U.S. Cl.
CPC ..... *A47B 81/00* (2013.01); *A47B 83/001* (2013.01); *A47B 83/045* (2013.01); *A47B 85/08* (2013.01); *A47B 91/06* (2013.01); *B01L 1/00* (2013.01); *A47B 2037/005* (2013.01); *A47B 2083/003* (2013.01); *A47B 2200/008* (2013.01); *A47B 2220/01* (2013.01); *B01L 2200/02* (2013.01); *B01L 2200/026* (2013.01); *B01L 2300/023* (2013.01)

(58) Field of Classification Search
CPC ..... A47B 83/045; A47B 2083/003; A47B 2200/008; A47B 2220/01
USPC ..... 312/249.8, 249.9
See application file for complete search history.

(56) References Cited

U.S. PATENT DOCUMENTS 1,948,703 A * 2/1934 Fanarjian ..... A47B 17/036 312/196
2,507,922 A * 5/1950 Miller ..... B01L 9/02 119/417
2,854,309 A * 9/1958 Levine ..... A47B 17/065 108/93
3,078,133 A * 2/1963 Schauer ..... A47B 46/00 211/150
3,936,110 A * 2/1976 Meggs ..... A47B 46/00 108/38
4,478,467 A * 10/1984 Tyndall ..... A47B 43/00 211/87.01
4,491,375 A * 1/1985 Ugalde ..... A47B 21/00 312/249.12
4,502,742 A * 3/1985 Neff ..... A47B 53/00 312/321.5
4,838,175 A * 6/1989 Hauville ..... B01L 9/02 108/25
5,020,867 A * 6/1991 McManus ..... A47B 77/10 312/140.2
5,536,080 A 7/1996 Madimenos et al.
5,558,418 A 9/1996 Lambright et al.
5,743,603 A * 4/1998 Kelley ..... A47B 17/065 16/19
5,820,238 A * 10/1998 Lambright ..... A47B 46/00 312/291
6,048,044 A * 4/2000 Biggel ..... A47B 21/00 312/223.3
6,053,588 A * 4/2000 Biggel ..... A47B 21/00 312/249.11
6,422,668 B1 7/2002 Kelley et al.
6,463,862 B1 * 10/2002 Kuhlman ..... A47B 21/0073 108/24
6,692,092 B1 * 2/2004 Evans ..... A47B 46/00 312/249.9
2006/0163984 A1 * 7/2006 Andersen ..... A47F 3/0486 312/401
2006/0250056 A1 * 11/2006 Fitzgerald ..... A47F 3/02 312/249.9
2007/0035219 A1 * 2/2007 Andersen ..... A47F 3/0486 312/249.9
2012/0048150 A1 * 3/2012 Moore ..... E03C 1/328 108/20

* cited by examiner

LABORATORY DEVICE

The invention relates to a laboratory device according to the preamble of claim 1.

It is known to implement rooms for carrying out laboratory experiments as complete room concepts in buildings. Therefore, in particular in teaching facilities, such as schools, there are rooms for theoretical teaching content and rooms for practical teaching. This in particular concerns natural science departments, such as chemistry, biology and physics.

In the past, these teaching rooms were generally designed as presentation rooms in which experiments were demonstrated and possibly carried out by individual students. The remaining individuals sat in the auditorium.

In accordance with current pedagogical priorities, the teaching is shifting more to active involvement of the learners. Therefore, the number of ascending auditoriums is being reduced in favor of flat experimental laboratories with individual or group work stations for the learners.

Schools in particular frequently have the problem that different types of education have to take place in the same room. The smaller the school, the less special laboratory rooms are worthwhile.

It is therefore the object of the invention to develop a laboratory device which eliminates the disadvantages of the prior art and permits flexible use of a laboratory room in a simple manner. As far as possible, the laboratory device is intended to be of simple construction, of robust design and to be easily handleable and cost-effective.

Main features of the invention are specified in the characterizing part of claim 1. Embodiments are the subject matter of claims 2 to 15.

The invention relates to a laboratory device with a cupboard which has an internal cupboard space, wherein a laboratory bench which has connections for media and/or data is mounted on the cupboard so as to be pivotable via an axis of rotation at least between a first pivoted position and a second pivoted position, wherein the laboratory bench is positioned in the cupboard space in the first pivoted position and is at least partially arranged outside the cupboard space in the second pivoted position.

The advantage of such an arrangement is that instruction or teaching rooms with such a laboratory device permit multiple use with different types of instruction or teaching. These types of instruction include, inter alia, classical instruction from the front, work in small working groups and work in experiment groups in natural science subjects.

For frontal teaching to be carried out, the laboratory bench according to the invention can be stowed in the internal cupboard space of the cupboard. The cupboard forms, as it were, a garage for the laboratory bench. Virtually the entire area of the room is therefore available. Tables and chairs can then be placed, for example, in rows easily and according to purpose.

At the same time, all of the connections of the laboratory bench can be protected within the cupboard against access. In addition, the combination of laboratory bench and cupboard has the advantage that there is a complete, but also highly compact unit. For construction and removal, it is not required to do more than to pivot the laboratory bench and possibly to move tables and chairs. The laboratory bench connections, for example power, water, waste water, gases, media, etc., can namely always remain fully connected. For this purpose, all supply and disposal lines and cables are intended to be connected to the cupboard. These lines and cables can be guided from the cupboard via the laboratory bench to the fittings and installation sockets provided by the laboratory bench. The lines and cables preferably lead closely past the axis of rotation or are guided through the axis of rotation. There is therefore clear guidance, and the durability of the lines and cables can be calculated and is at a high level, and bending and damage due to handling are prevented.

In order to secure the laboratory bench in the second pivoted position, a braking means can be provided between the laboratory bench and the base, and/or a latching means can be provided between the laboratory bench and the cupboard.

The configuration of a cupboard customarily comprises a front side, a rear side, an upper side, side walls and a base side. A cupboard base is not absolutely required because the base side is closed by the floor area. For laboratory devices according to the invention, both side boards and high boards are suitable as types of cupboard. High boards provide additional storage space, in particular for teaching materials and laboratory tools. However, they can generally only be placed on walls. Side boards can be placed more flexibly in the room because, given an appropriate height, it is possible to see over them even when sitting. Side boards are therefore suitable, for example, for placing in front of a wall, a window facade or freely in the room, for example in the spatial axis.

In a preferred embodiment of the invention, the axis of rotation is oriented geodetically vertically. Consequently, the laboratory bench can be pivoted horizontally. All loose objects in, at or on the laboratory bench therefore do not have to be secured or cleared away before a pivoting operation. Experimental setups can thus remain built up until the next teaching unit and also be pivoted into the cupboard interior. The experimental setup can therefore be protected in the cupboard against access. Protruding monitors, pivoting arms and the like can also be simply retracted.

A further refinement of the invention makes provision for the laboratory bench to be pivotable by at least 80 degrees about the axis of rotation. The laboratory bench therefore stands a long way out of the cupboard and is readily accessible to individuals. In particular, a plurality of individuals can also be arranged around the laboratory bench. Pivoting by at least 90 degrees is preferably possible.

According to a special refinement, the laboratory bench has a supporting means for supporting on a base (in particular the floor), which supporting means is arranged outside the cupboard space in the second pivoted position. Laboratory benches may have a considerable dead weight. In addition, individuals readily support themselves on a laboratory bench when working. By means of the provision of a supporting means, the axis of rotation and the laboratory bench can be formed cost-effectively and with a low degree of rigidity. In addition, tipping over is prevented.

The laboratory bench particularly preferably has rollers for supporting on the base, in particular on the floor. The laboratory bench can therefore be easily pivoted. In addition, the laboratory bench can be supported by a roller in every position between the first and the second pivoted position. The roller preferably sits at the end of the laboratory bench opposite the axis of rotation. The laboratory bench optionally has at least two rollers, and therefore at least one three-point mounting of the laboratory bench relative to the base is produced together with the axis of rotation. Accordingly, the laboratory bench then stands stably and does not tend to tilt. A roller is preferably combined with a recess in the cupboard base or in a base-free cupboard. The roller then does not have to be guided over a step during the pivoting of the laboratory bench.

Furthermore, different variants of laboratory benches make provision for the latter to have at least one of the following connections: a power connection, a water connection, a gas connection, a liquid outlet, an air extractor or a switching element (for example a push button), and/or to have one of the following features: a working surface, a water tap, a basin, a gas tap or a microscope. Such a laboratory bench can optionally be supplemented by a working light, a computer, a monitor, a network connection, an image signal connection, a switching element for switching image signal sources, and/or a (table) camera.

A working surface is optional insofar as the latter can also be provided by separate working tables of the laboratory device. Said working tables are also intended to be suitable for frontal teaching. However, it is helpful, specifically for chemical experiments, to provide a chemically stable working surface on the laboratory bench.

Most technical experiments in physics lessons in schools should be able to be carried out if a basic configuration of the laboratory bench with a power connection is provided.

A basic configuration with a power connection, a water connection with a water tap, a liquid outlet, a basin and a gas connection is suitable for lessons in biology and chemistry. This basic configuration could be supplemented by a gas extractor if experiments are also carried out in which poisonous or unpleasant gases could arise. Microscopes can optionally also be accommodated externally and set up as required. The cupboard and/or the laboratory bench can provide storage space for this purpose.

Consequently, the laboratory bench can be configured in such a manner that all necessary devices for lessons in natural sciences are kept ready.

A working light by which the laboratory bench can optionally be supplemented is frequently helpful when carrying out experiments.

Modern forms of teaching increasingly involve new communication means in the lessons, and therefore supplementing the laboratory bench with a computer, a monitor, a network connection, an image signal connection, other image signal inputs and/or outputs, switching elements for switching image signal sources and/or a camera may be expedient. If the laboratory device comprises a plurality of laboratory benches in a room, camera and screen can be in communication with each other in an interconnected manner via the configuration with image signal connections. As a result, individual pupils or the teacher can easily share content, for example working instructions or results. The camera is preferably held on a maneuverable arm in order to be able to be positioned flexibly. Each laboratory bench can be configured, for example, with up to 5 HDMI inputs to which pupils can connect a notebook or tablet computer. By pushing a push button, content could then be shared, for example, with other reproduction devices, such as, for example, with monitors of the laboratory bench, a central room monitor, a beamer or a smart board. A flexibly pivotable camera would be suitable, inter alia, to share a real time image with the individual work stations at the laboratory bench, the teacher or with a central room monitor. Devices for the wireless transmissions of image and sound on the basis of current and future standards, for example MiraCast, Apple TV or WiDi, can be integrated in the laboratory bench.

Furthermore, a further embodiment of the invention makes provision for the cupboard to have a cupboard door. A cupboard door is suitable for producing a harmonious and high-quality visible side of the laboratory device. For this purpose, the cupboard door is intended to be able to close the cupboard at least together with a wall of the laboratory bench, except, however, for open shelves provided in the cupboard. According to a special configuration, the cupboard door conceals the laboratory bench, in particular completely, in the first pivoted position. The laboratory bench can therefore be configured in a flexible manner since it is not required as a closure element for part of the cupboard.

An embodiment in which the cupboard is at least partially closable with the cupboard door in the second pivoted position of the laboratory bench is optional. There is therefore a high-quality impression of space even when laboratory benches are pivoted out because there is not a view into the empty space of open cupboards. At the same time, the cupboard door is in a non-disturbing position and permits a large working area around the laboratory bench.

A special variant of the invention makes provision for the cupboard door to consist of a plurality of door elements. These can be two segments. Then, for example, one of the segments can be folded away rearward such that the second segment can close the cupboard in the second pivoted position. Such a type of door is also referred to as a folding door. However, it may also be a multi-part sliding door which can be slid again alongside after the laboratory bench is pivoted out. In addition, roller shutters consisting of a multiplicity of segments can be used.

A variant of the laboratory device is particularly space-saving, in which the axis of rotation is arranged on one side of the cupboard and a hinge of the cupboard door is arranged on the opposite side of the cupboard. The laboratory bench can then have virtually the same length as the width of the cupboard. Therefore, a plurality of cupboards with a laboratory bench can be accommodated in a laboratory room with limited availability, and more work stations are available.

Furthermore, an optional addition of the laboratory device makes provision for the cupboard door to have a supporting roller for supporting on a base, in particular the floor. It is therefore possible to stably pivot relatively long doors without the cupboard and the door hinge having to be of particularly stiff design. Since the laboratory bench is pivoted out, it is appropriate namely to mount the cupboard door exclusively on one side of the cupboard such that the cupboard door extends over the entire cupboard width.

Since, in order to carry out laboratory experiments, tools which go beyond the pure laboratory bench are generally required, a variant of the invention is particularly favorable in which the laboratory bench has an internal storage space.

A laboratory device in which the laboratory bench has a rim, against which, in the second pivoted position, at least one working table can be placed, provides a particularly flexible space concept. Consequently, at least a part of the working tables which are required for frontal teaching is also used for practical teaching content at the laboratory bench. The working tables accordingly do not have to be cleared aside. In addition, use is made of an available working surface which does not have to be part of the laboratory bench. The laboratory bench and the cupboard can be configured in a correspondingly compact manner.

It is appropriate to equip the working table or the working tables with rollers, in particular on one side, in order to be able to carry out the spatial reconfiguration of the laboratory device as rapidly and simply as possible and with little noise.

The outer shape of the laboratory bench determines the preferred type of the working tables. In particular, a rectangular basic shape or, for example, a regular polygonal head end is suitable for the laboratory bench. A rectangular laboratory bench may be supplemented by placing (classical) rectangular working tables thereagainst. In the case of a polygonal head end of the laboratory bench, in particular trapezoidal working tables are suitable for placing thereagainst in order to provide a closed polygonal working surface around the head end. In particular, octagonal working tables can also be used. If a laboratory bench for frontal teaching is involved, i.e. which laboratory bench is preferably used by the teacher, a rectangular basic shape is the preferred choice. The (teacher's) desk can simply be placed thereagainst. Round or polygonal table arrangements are particularly suitable for small working groups because each is positioned here approximately the same distance from the laboratory bench and experimental setup. This gives rise to fewer conflicts regarding the best work stations.

The invention also relates to a laboratory device in which the laboratory bench has a rim, against which, in the second pivoted position, at least one working table is placed. In a preferred embodiment, a plurality of working tables, in particular at least three to at most eight working tables, are placed against the rim or the rims of the laboratory bench.

Furthermore, a supplement of the invention makes provision for at least two working chairs to be able to be positioned or in particular to be positioned at the working table or the working tables which are placed against the rim of the laboratory bench.

The working height of the laboratory bench is preferably at least as high as that of the working tables placed thereagainst. The laboratory device is particularly flexible if the height of the laboratory bench can be adjusted. By this means, it can be adapted to the height of working tables of children of different ages.

Furthermore, a variant of the invention can be designed in a particularly compact manner, in which at least one structure is designed such that it can be folded over flat on the laboratory bench, in particular by means of a flexible coupling or a pivoting joint. This can relate, inter alia, to a water connection, a water tap, an air extractor, a working light, a monitor or a camera.

A particularly high level of security is achieved if the cupboard is lockable with an optional lock, for example with a door lock. Children especially then cannot use the laboratory bench without authorization and possibly access further tools in the cupboard. The security can be furthermore increased by the fact that the laboratory device has switches and/or valves which can be enabled centrally. The teacher could then enable the required connections of the laboratory bench, for example power, gas and water, to meet requirements. For this purpose, the laboratory device can have a control unit. A laboratory bench or a plurality of laboratory benches is or are connectable to such a control unit. The control unit is intended to have a safety lock, for example a key, a card reader or the like. An automatic switching-off of all (safety-relevant) connections of the laboratory bench is desirable in the first pivoted position.

According to the invention, a second laboratory bench may optionally be additionally arranged in a cupboard. In this way, such a cupboard is suitable for a plurality of individuals. A laboratory device can also be designed in such a manner that a plurality of cupboards with at least one laboratory bench in each case are provided in a room.

The invention therefore also relates to a laboratory device comprising a laboratory room with a cupboard which has an internal cupboard space, wherein a laboratory bench is mounted on the cupboard so as to be pivotable via an axis of rotation, wherein at least two working tables and two working chairs are provided in the laboratory room, and wherein the laboratory bench is positioned in the cupboard space in a first pivoted position about the axis of rotation, and the working tables and working chairs are arranged separately in the laboratory room, and wherein the laboratory bench is at least partially arranged outside the cupboard space in a second pivoted position about the axis of rotation, and the working tables and working chairs are arranged around the laboratory bench, in particular are placed thereagainst.

This has the same advantages as described previously, and can be combined with all of the previously described features.

Further features, details and advantages of the invention emerge from the wording of the claims and from the description below of exemplary embodiments with reference to the drawings, in which:

Figure 1:
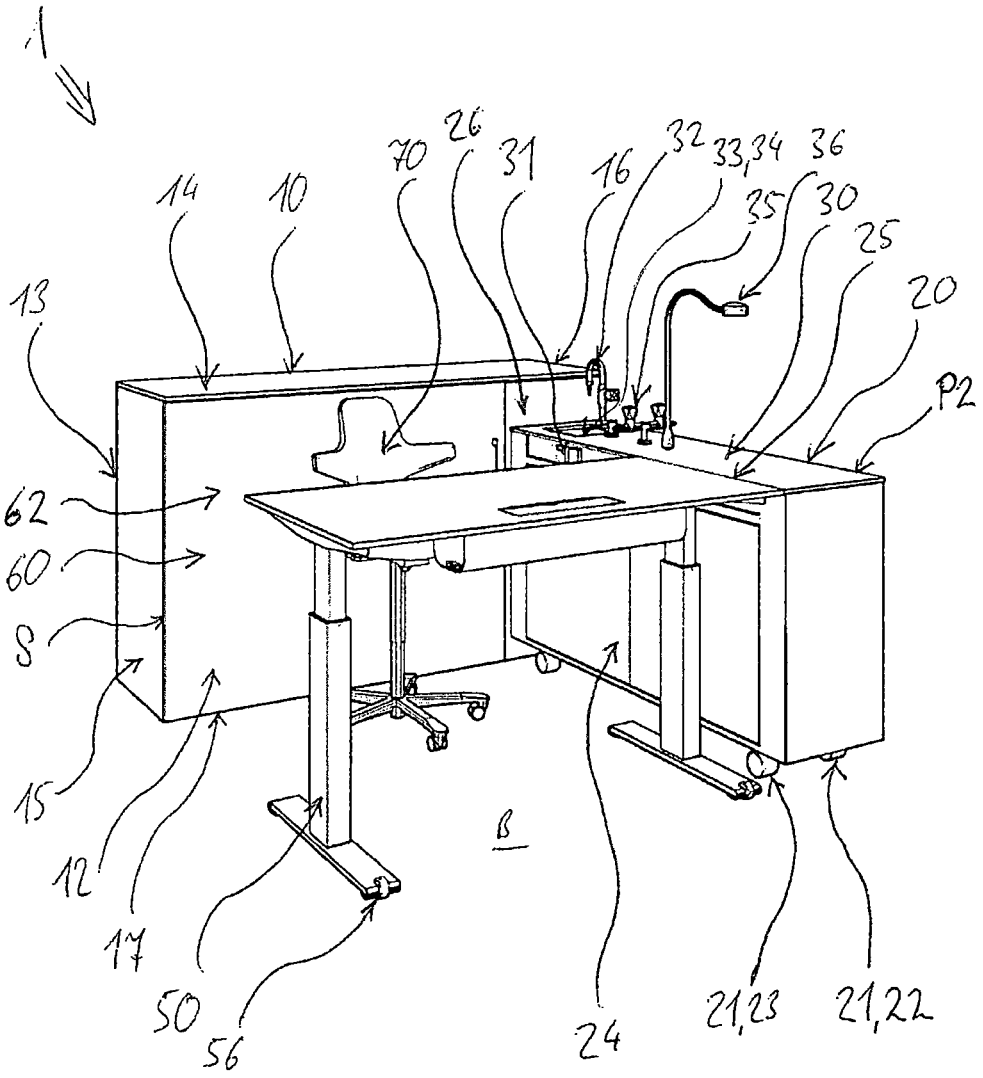
FIG. 1 shows a three-dimensional illustration of a laboratory device with a cupboard, a laboratory bench in a second pivoted position and a working table with a working chair.
Figure 3A:
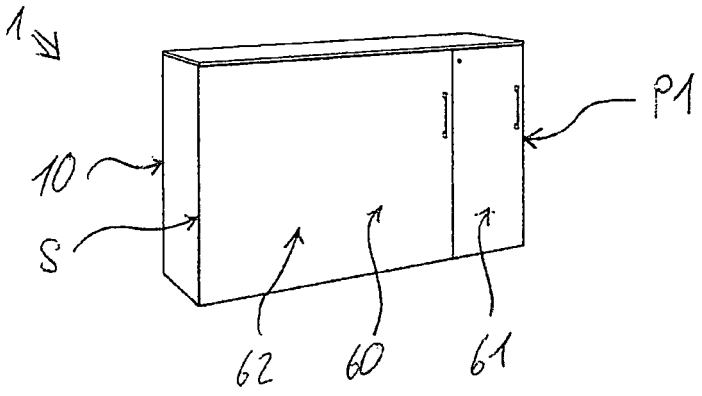
Figure 3B:
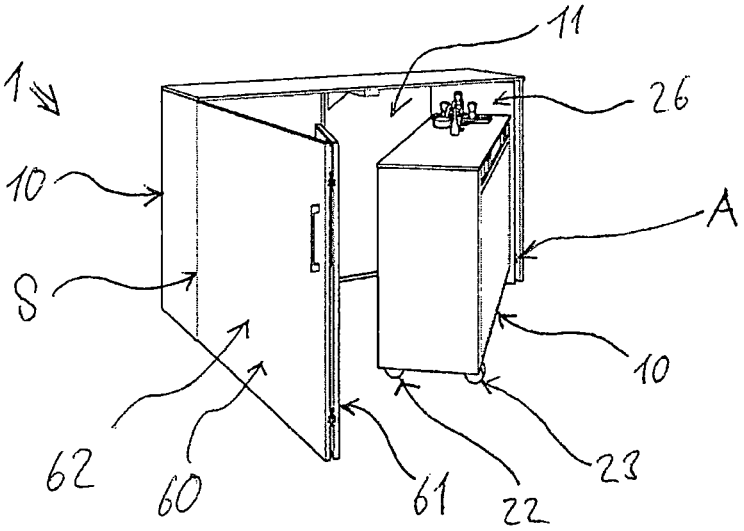
Figure 3C:
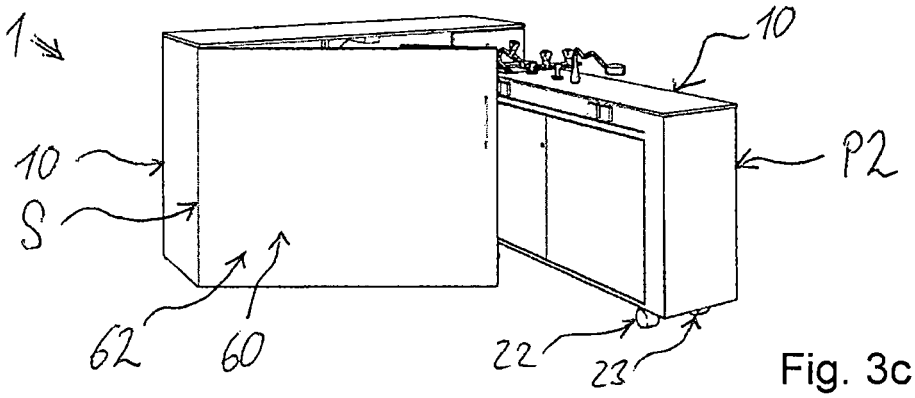
Figure 4A:
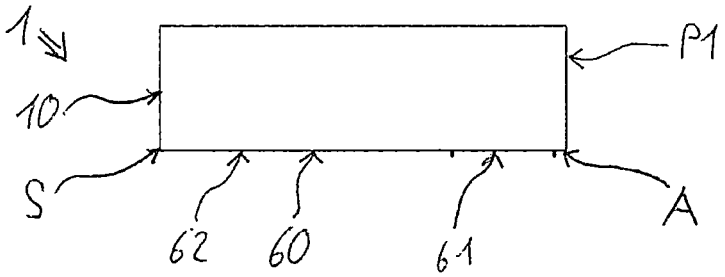

FIG. 3*a* shows a three-dimensional illustration of the cupboard shown in FIG. 1, with the laboratory bench in the first pivoted position;

FIG. 3*b* shows a three-dimensional illustration of the cupboard shown in FIG. 3*a*, with the laboratory bench in a position between the first and second pivoted position;

FIG. 3*c* shows a three-dimensional illustration of the cupboard shown in FIGS. 3*a* and 3*b*, with the laboratory bench in a second pivoted position;

FIG. 4*a* shows a top view of FIG. 3*a;*

Figure 4B:
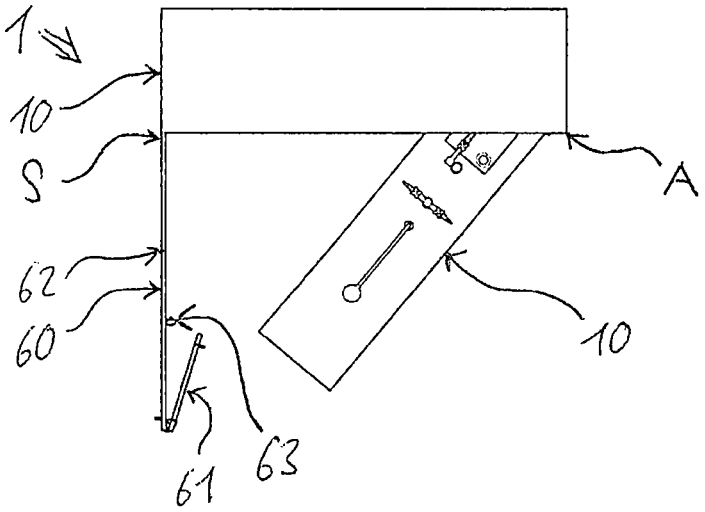

FIG. 4*b* shows a top view of FIG. 3*b;*

Figure 4C:
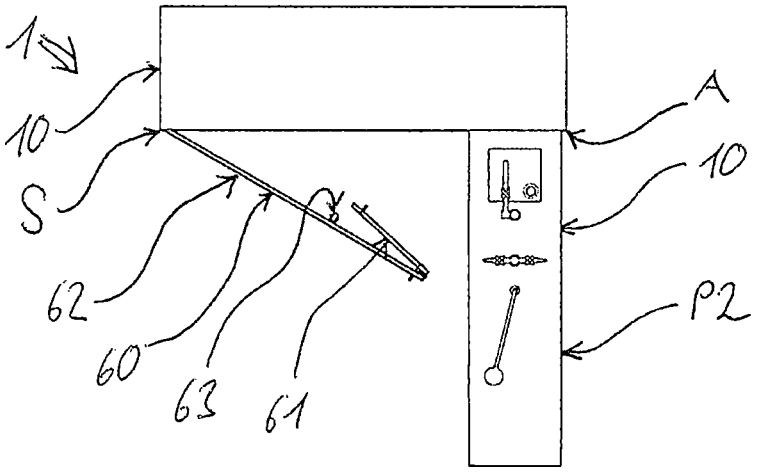

FIG. 4*c* shows a top view of FIG. 3*c;*

Figure 5:
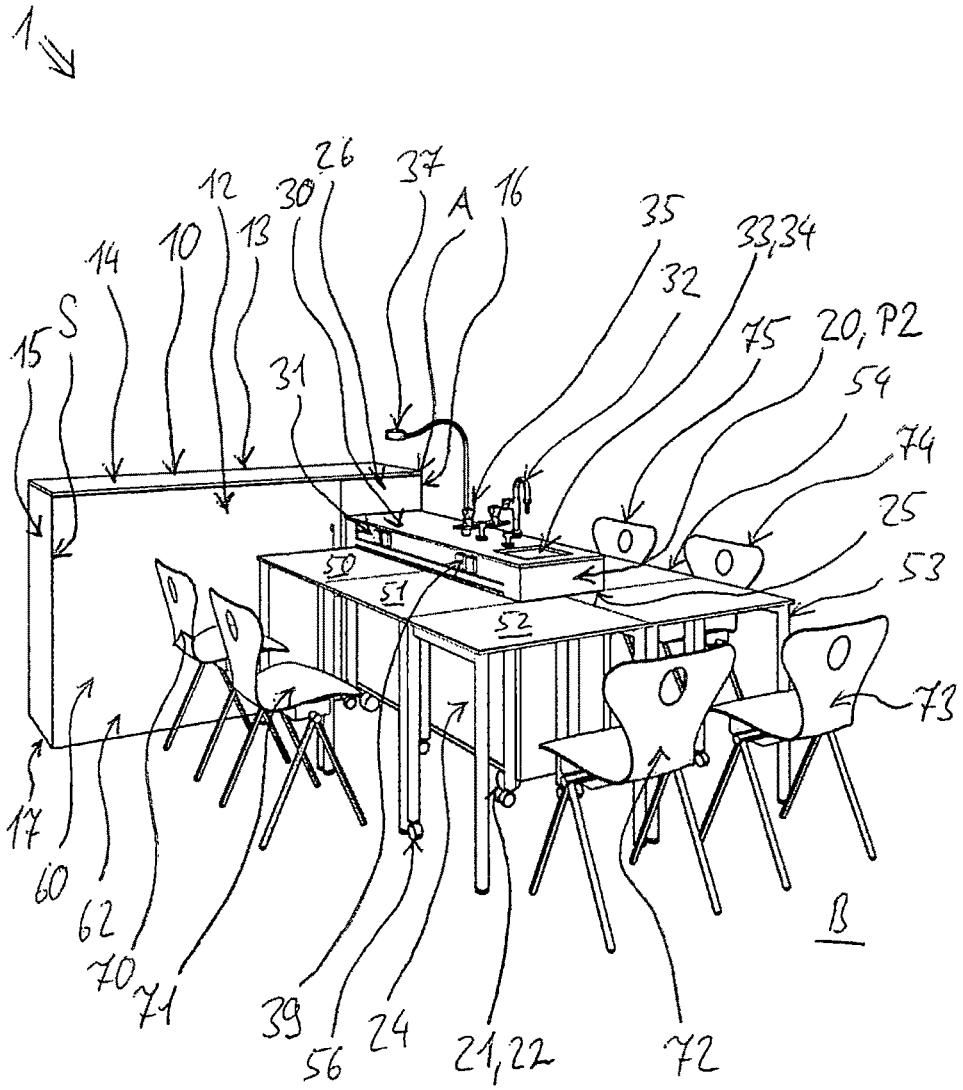
Figure 6A:
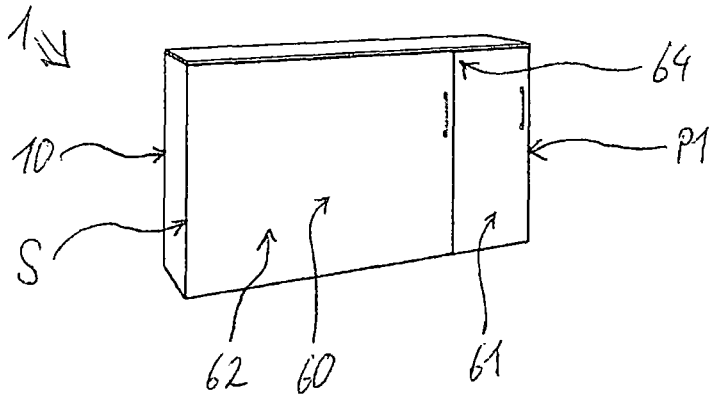
Figure 6B:
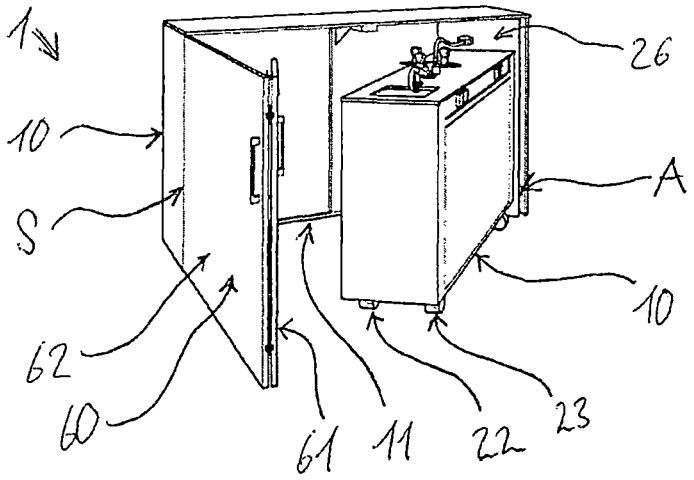
Figure 6C:
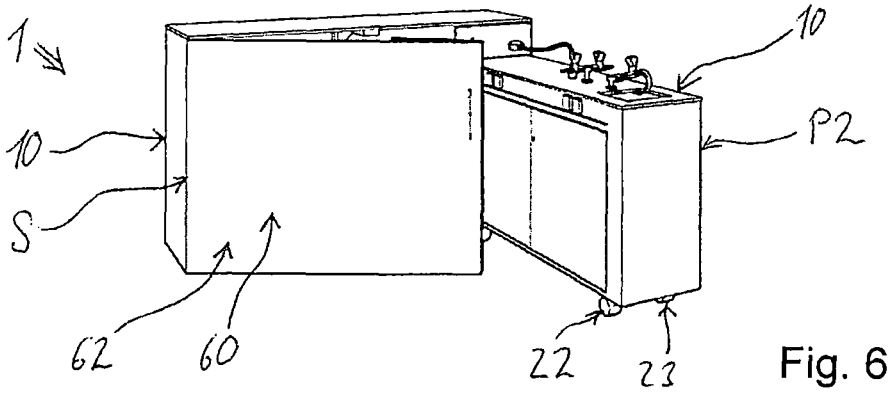
Figure 7A:
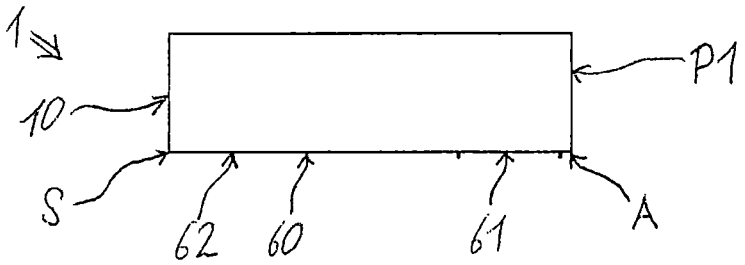

FIG. 5 shows a three-dimensional illustration of a laboratory device with a cupboard, a laboratory bench in a second pivoted position and six working tables with working chairs;

FIG. 6*a* shows a three-dimensional illustration of the cupboard shown in FIG. 5, with the laboratory bench in the first pivoted position;

FIG. 6*b* shows a three-dimensional illustration of the cupboard shown in FIG. 6*a*, with the laboratory bench in a position between the first and second pivoted position;

FIG. 6*c* shows a three-dimensional illustration of the cupboard shown in FIGS. 6*a* and 6*b*, with the laboratory bench in a second pivoted position;

FIG. 7*a* shows a top view of FIG. 6*a;*

Figure 7B:
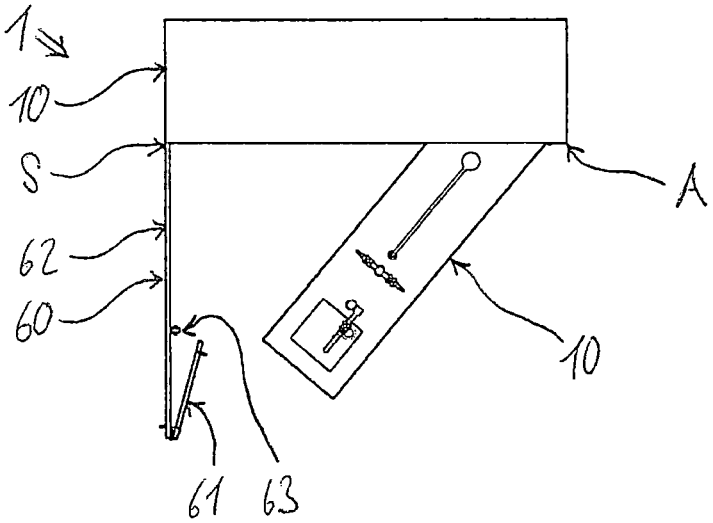

FIG. 7*b* shows a top view of FIG. 6*b;*

Figure 7C:
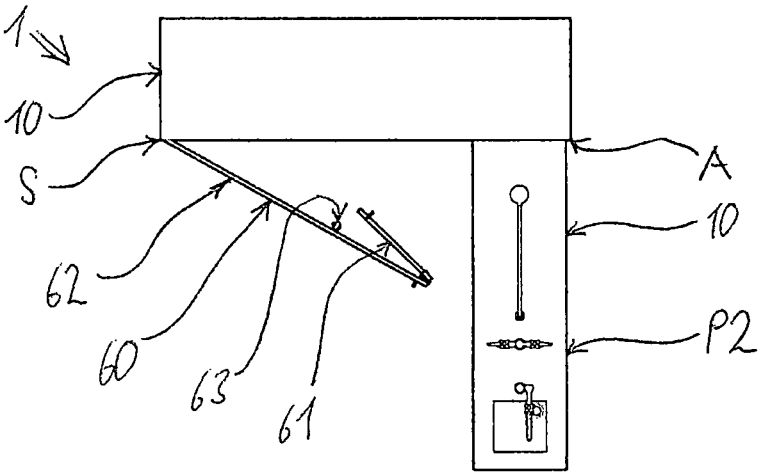

FIG. 7*c* shows a top view of FIG. 6*c;*

Figure 8:
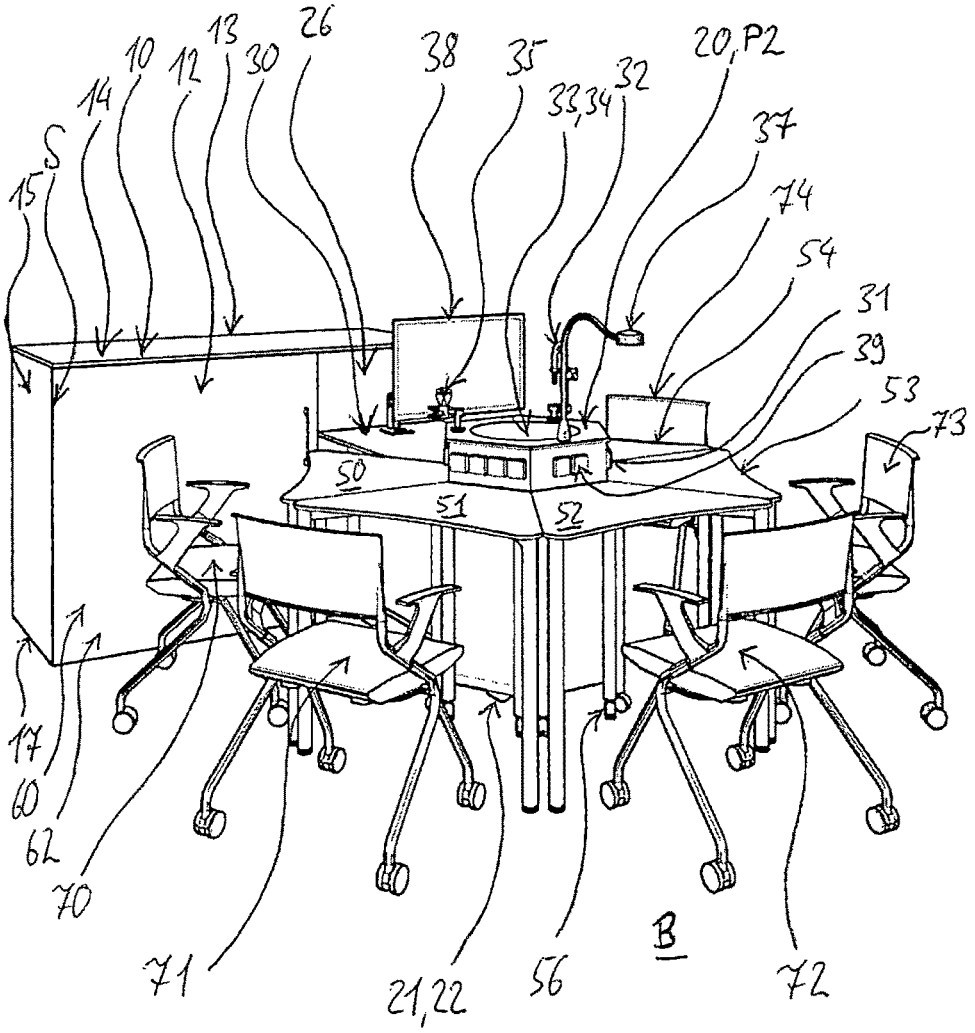
Figure 9A:
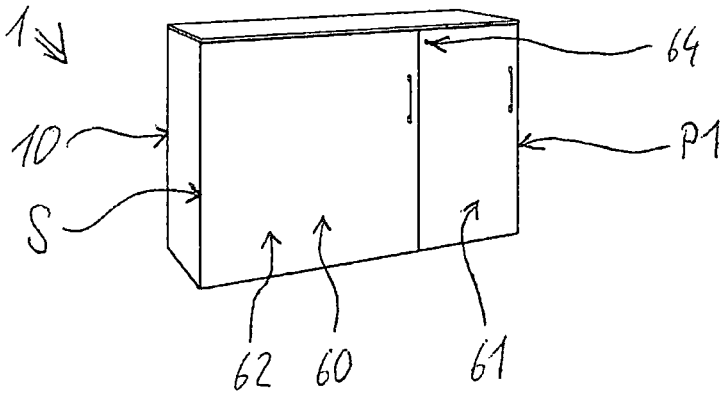
Figure 9B:
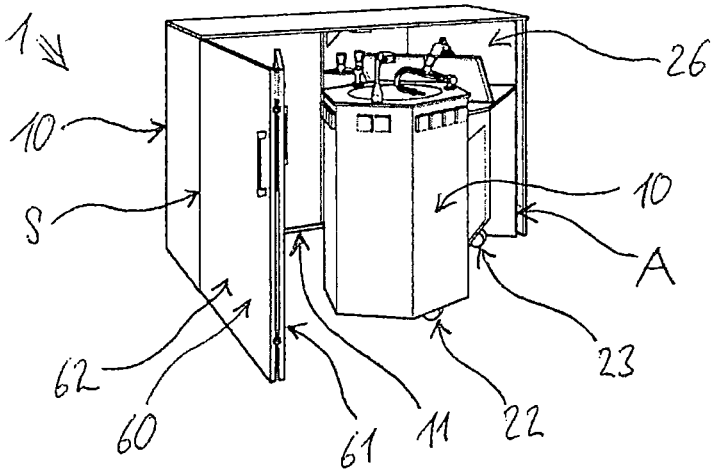
Figure 9C:
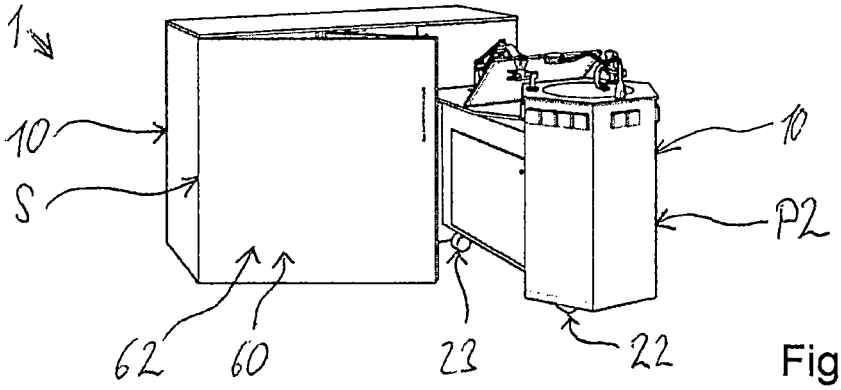
Figure 10A:
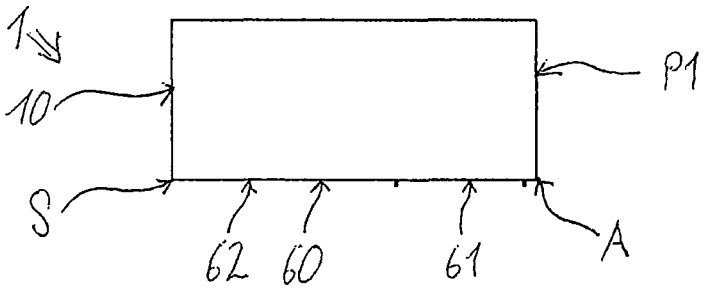

FIG. 8 shows a three-dimensional illustration of a laboratory device with a cupboard, a laboratory bench in a second pivoted position and five polygonally arranged working tables with working chairs;

FIG. 9*a* shows a three-dimensional illustration of the cupboard shown in FIG. 8, with the laboratory bench in the first pivoted position;

FIG. 9*b* shows a three-dimensional illustration of the cupboard shown in FIG. 9*a*, with the laboratory bench in a position between the first and second pivoted position;

FIG. 9*c* shows a three-dimensional illustration of the cupboard shown in FIGS. 9*a* and 9*b*, with the laboratory bench in a second pivoted position;

FIG. 10*a* shows a top view of FIG. 9*a;*

Figure 10B:
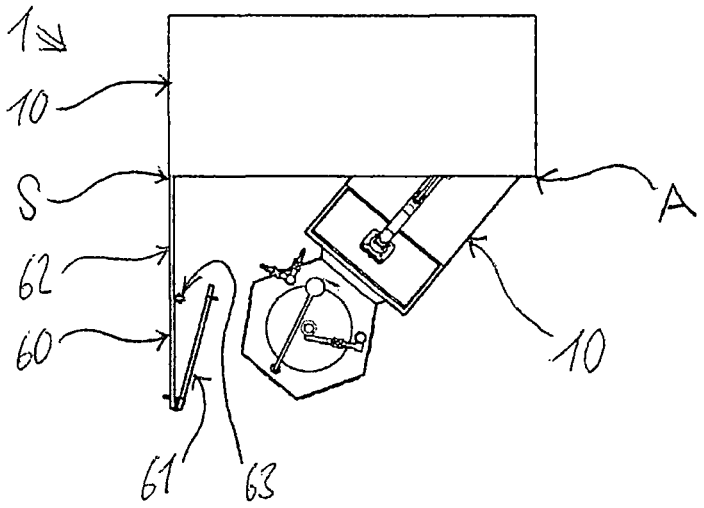

FIG. 10*b* shows a top view of FIG. 9*b*; and

Figure 10C:
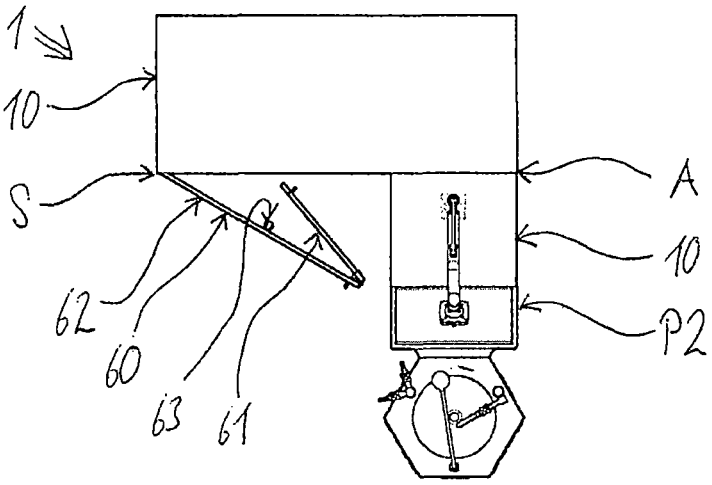

FIG. 10*c* shows a top view of FIG. 9*c*.

FIGS. 1, 5 and 8 each show a three-dimensional illustration of a laboratory device 1 with a cupboard 10, a laboratory bench 20 in a second pivoted position P2 and different numbers of work stations consisting of a working table 50, 51, 52, 53, 54 and a working chair 70, 71, 72, 73, 74, 75. In the second pivoted position P2, the laboratory bench 20 protrudes at a right angle from the cupboard 10.

The cupboard 10 in each case has an internal cupboard space (see in this respect reference sign 11 in FIGS. 3*b*, 6*b*, 9*b*) which is enclosed by a front side 12, a rear side 13, an upper side 14, side walls 15, 16 and a base side 17. It is seen by way of the overall height of the cupboard 10 in relation to the working chairs 70, 71, 72, 73, 74, 75 and working tables 50, 51, 52, 53, 54 that said cupboard is designed in each case as a side board. The height is approximately 1.1 meters. Alternatively, the cupboard may also be designed as a high board, for example with a height of over 2 meters.

The laboratory bench 20 is mounted on the cupboard so as to be pivotable via an axis of rotation A (concealed by structures on the laboratory bench 20 in FIGS. 1 and 3) in such a manner that it can be positioned in the cupboard space in a first pivoted position about the axis of rotation A, and is arranged outside the cupboard space 11 in the second shown pivoted position P2 about the axis of rotation A. For this purpose, the axis of rotation A is oriented geodetically vertically.

It is seen that the laboratory bench 20 has a supporting means 21, namely rollers 22, 23, for supporting on the base (floor) B. In the second pivoted position P2, the rollers 22, 23 are arranged outside the cupboard space 11 because they are arranged at the end of the laboratory bench 20 that is opposite the axis of rotation A.

It is furthermore seen that the cupboard 10 has a cupboard door 60. The cupboard door 60 consists of two door elements 61, 62 (the first door element 61 is concealed in FIGS. 1, 5 and 8, but is indicated in FIGS. 2, 3*a*, 3*b*, 4*b*, 4*c*, 6*a*, 6*b*, 7*b*, 7*c*, 9*a*, 9*b*, 10*b*, 10*c*). The first door element 61 is fastened to the second door element 61 via an inwardly opening hinge with a vertical axis of rotation. The second door element 62 in turn is fastened to the first side wall 15 via an outwardly opening hinge S with a vertical axis of rotation. It is clear that the axis of rotation A of the laboratory bench 20 and the hinge S of the cupboard door 60 are arranged on opposite sides on the side walls 15, 16 of the cupboard 10.

In the second shown pivoted position P2 of the laboratory bench 20, the cupboard door 60 closes the cupboard 10 with the second door element 62 except for the laboratory bench 20. The remaining region of the front side 12 of the cupboard is closed by the laboratory bench 20. For this purpose, the laboratory bench 20 has an upwardly protruding panel 26. The panel 26 preferably ends, as shown, at the same height as the cupboard door 60.

A storage space 24 which is closable with doors is provided within the laboratory bench 20. The higher structures 32, 33, 34, 36, 37, 38 on the laboratory bench 20, in particular those which protrude over the height of the cupboard, are designed in such a manner that they are designed such that they can be folded over flat in order to store the laboratory bench 20 in the cupboard 10.

In FIG. 1, the laboratory bench 20 has a working surface 30, power connections 31, a water connection with a water tap 32, a basin 34 with a liquid outlet 33, a gas connection with a gas tap 35, and a working lamp 36.

The laboratory bench 20 has a rim 25, against which a working table 50 and a working chair 70 are placed in the second pivoted position P2 shown. A laboratory device 1 fitted in such a manner is suitable, for example, as a simple demonstration laboratory surface for a teacher.

According to FIG. 5, the laboratory bench 20 has a working surface 30, power connections 31, a water connection with a water tap 32, a basin 34 with a liquid outlet 33, a gas connection with a gas tap 35, a camera 37 and network connections 39.

In the second pivoted position P2 shown, six working tables 50, 51, 52, 53, 54 and six working chairs 70, 71, 72, 73, 74, 75 are placed in a rectangular table formation against a rim 25 of the laboratory bench 20. A laboratory device 1 equipped in such a manner is suitable, for example, as a group work station for up to six learners.

FIG. 8 shows a laboratory bench 20 which has a working surface 30, power connections 31, a water connection with a water tap 32, a basin 34 with a liquid outlet 33, a gas connection with a gas tap 35, a camera 37, a screen 38 and network connections 39.

In the second pivoted position P2 shown, five trapezoidal working tables 50, 51, 52, 53, 54 and five working chairs 70, 71, 72, 73, 74, 75 are placed in a polygonal table formation against a rim 25 at the head end of the laboratory bench 20, which has a regular hexagonal basic shape. A laboratory device 1 equipped in such a manner is suitable, for example, as a group work station for up to five learners.

Figure 2:
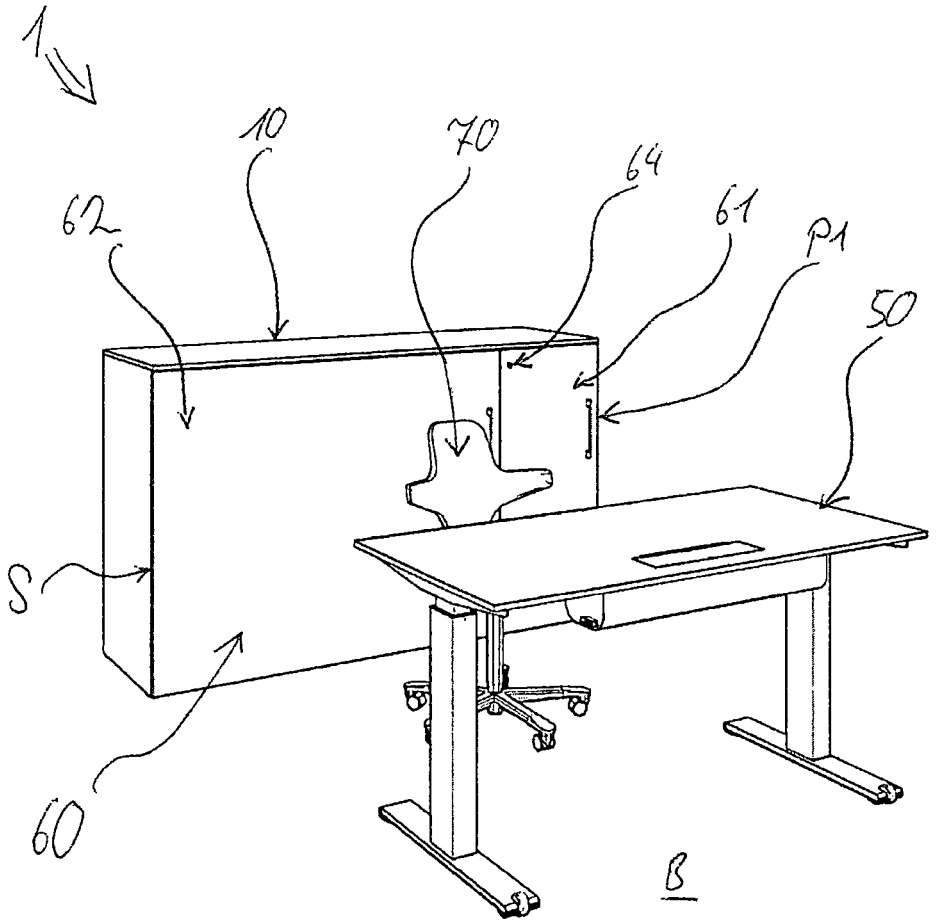
FIG. 2 shows a three-dimensional illustration of the laboratory device shown in FIG. 1, in the first pivoted position.

FIG. 2 shows a three-dimensional illustration of the laboratory device 1 shown in FIG. 1, in the first pivoted position P1. The working table 50 and the working chair 70 can be installed flexibly in the room and stand here in front of the cupboard 10. The cupboard 10 is closed with the cupboard door 60, and therefore the laboratory bench 20 (not visible here) is inserted in a completely concealed manner in the cupboard space in the first pivoted position P1. As is seen, the region of the laboratory bench in the first pivoted position P1 is concealed by the first door element 61. The cupboard door 10 is lockable with a lock 64. The latter is located in the region of the hinge between the first and second door element 61, 62. Here in particular in the first door element 61. For the description of the other reference signs, reference should be made to the description regarding FIG. 1.

A three-dimensional illustration of the cupboard 10 shown in FIG. 1, with the laboratory bench 20 in the first pivoted position P1 is seen in FIG. 3*a*. By opening of the cupboard door 60 and pivoting of the laboratory bench 10 out about the axis of rotation A, a position is reached between the first and second pivoted position P1, P2, as becomes clear in the three-dimensional illustration in FIG. 3*b*. It is also seen in this FIG. 3*b* that the cupboard 10 does not have a cupboard base. FIG. 3*c* shows a three-dimensional illustration of the cupboard 10 shown in FIGS. 3*a* and 3*b*, with the laboratory bench 20 in a second pivoted position P2. By folding of the first door element 61 over behind the second door element 62, the cupboard door 60 can be closed again in the second pivoted position P2 of the laboratory bench 20. The further reference signs in FIGS. 3*a*, 3*b* and 3*c* are explained above in the description regarding FIG. 1. It is seen that the higher structures are folded flat so that they can be moved into the cupboard space 11.

FIG. 4*a* is a top view of FIG. 3*a*, FIG. 4*b* is a top view of FIG. 3*b* and FIG. 4*c* is a top view of FIG. 3*c*. To this extent, reference should be made to the description regarding FIGS. 1, 3*a*, 3*b* and 3*c*. As a further detail, it is seen in FIGS. 4*b* and 4*c* that the cupboard door 60 has a supporting roller 63 for supporting on the base (floor).

A three-dimensional illustration of the cupboard 10 shown in FIG. 5, with the laboratory bench 20 in the first pivoted position P1 is seen in FIG. 6*a*. By opening of the cupboard door 60 and pivoting of the laboratory bench 10 out about the axis of rotation A, a position is reached between the first and second pivoted position P1, P2, as becomes clear in the three-dimensional illustration in FIG. 6*b*. It is also seen in this FIG. 6*b* that the cupboard 10 does not have a cupboard base. FIG. 6*c* shows a three-dimensional illustration of the cupboard 10 shown in FIGS. 6*a* and 6*b*, with the laboratory bench 20 in a second pivoted position P2. By folding of the first door element 61 over behind the second door element 62, the cupboard door 60 can be closed again in the second pivoted position P2 of the laboratory bench 20. The further reference signs in FIGS. 6*a*, 6*b* and 6*c* are explained above in the description regarding FIG. 5. It is seen that the higher structures are folded flat so that they can be moved into the cupboard space 11.

FIG. 7*a* is a top view of FIG. 6*a*, FIG. 7*b* is a top view of FIG. 6*b* and FIG. 7*c* is a top view of FIG. 6*c*. To this extent, reference should be made to the description regarding FIGS. 5, 6*a*, 6*b* and 6*c*. As a further detail, it is seen in FIGS. 7*b* and 7*c* that the cupboard door 60 has a supporting roller 63 for supporting on the base (floor).

Finally, a three-dimensional illustration of the cupboard 10 shown in FIG. 8, with the laboratory bench 20 in the first pivoted position P1 is seen in FIG. 9*a*. By opening of the cupboard door 60 and pivoting of the laboratory bench 10 out about the axis of rotation A, a position is reached between the first and second pivoted position P1, P2, as becomes clear in the three-dimensional illustration in FIG. 9*b*. It is also seen in this FIG. 9*b* that the cupboard 10 does not have a cupboard base. FIG. 9*c* shows a three-dimensional illustration of the cupboard 10 shown in FIGS. 9*a* and 9*b*, with the laboratory bench 20 in a second pivoted position P2. By folding of the first door element 61 over behind the second door element 62, the cupboard door 60 can be closed again in the second pivoted position P2 of the laboratory bench 20. The further reference signs in FIGS. 9*a*, 9*b* and 9*c* are explained above in the description regarding FIG. 8. It is seen that the higher structures are folded flat so that they fit into the cupboard space 11.

FIG. 10*a* is a top view of FIG. 9*a*, FIG. 10*b* is a top view of FIG. 9*b* and FIG. 10*c* is a top view of FIG. 9*c*. To this extent, reference should be made to the description regarding FIGS. 8, 9*a*, 9*b* and 9*c*. As a further detail, it is seen in FIGS. 10*b* and 10*c* that the cupboard door 60 has a supporting roller 63 for supporting on the base (floor).

The invention is not restricted to one of the above-described embodiments, but rather can be modified in diverse ways.

All of the features and advantages revealed in the claims, the description and the drawing, including structural details, three-dimensional arrangements and method steps, may be essential to the invention both by themselves and in a very wide variety of combinations.

LIST OF REFERENCE SIGNS

1 laboratory device
10 cupboard
11 cupboard space
12 front side
13 rear side
14 upper side
15 first side wall
16 second side wall
17 base side
20 laboratory bench
21 supporting means
22 rollers (laboratory bench)
23 rollers (laboratory bench)
24 storage space (laboratory bench)
25 rim (laboratory bench)
26 panel
30 working surface
31 power connection
32 water tap
33 liquid outlet
34 basin
35 gas tap
36 working lamp
37 camera
38 screen
39 network connections
50 first working table
51 second working table
52 third working table
53 fourth working table
54 fifth working table
55 sixth working table
56 table rollers
60 cupboard door
61 first door element
62 second door element
63 supporting roller (cupboard door)
64 lock
70 first chair
71 second chair
72 third chair
73 fourth chair
74 fifth chair
75 sixth chair
A axis of rotation
B base
P1 first pivoted position
P2 second pivoted position
S hinge (cupboard door)

The invention claimed is:

1. A laboratory device (1) with a cupboard (10) which has an internal cupboard space (11), characterized in that a laboratory bench (20), which has connections for at least one of media and data, is mounted on the cupboard (10) so as to be pivotable via an axis of rotation (A) at least between a first pivoted position (P1) and a second pivoted position (P2), wherein the laboratory bench (20) is positioned in the cupboard space (11) in the first pivoted position (P1) and is at least partially arranged outside the cupboard space (11) in the second pivoted position (P2), and further wherein the laboratory bench (20) has at least one of:

a) a water connection;
b) a gas connection;
c) a water tap (32); and
d) a basin (34).

2. The laboratory device (1) as claimed in claim 1, characterized in that the axis of rotation (A) is oriented geodetically vertically.

3. The laboratory device (1) as claimed in claim 1, characterized in that the laboratory bench (20) is pivotable by at least 80 degrees about the axis of rotation (A).

4. The laboratory device (1) as claimed in claim 1, characterized in that the laboratory bench (20) has a supporting means (21) for supporting on a base (B), which supporting means is arranged outside the cupboard space (11) in the second pivoted position (P2).

5. The laboratory device (1) as claimed in claim 1, characterized in that the laboratory bench (20) has at least one of:

e) a liquid outlet (33);

f) an air extractor;

g) a switching element;

h) a working surface (30);

i) a gas tap (35);

j) a microscope; and k) a table camera.

6. The laboratory device (1) as claimed in claim 1, characterized in that the cupboard (10) has a cupboard door (60).

7. The laboratory device (1) as claimed in claim 6, characterized in that the cupboard door (60) conceals the laboratory bench (20) in the first pivoted position (P1).

8. The laboratory device (1) as claimed in claim 6, characterized in that the cupboard (10) is at least partially closable with the cupboard door (60) in the second pivoted position (P2) of the laboratory bench (20).

9. The laboratory device (1) as claimed in claim 6, characterized in that the cupboard door (60) consists of a plurality of door elements (61, 62).

10. The laboratory device (1) as claimed in claim 6, characterized in that the axis of rotation (A) is arranged on one side of the cupboard (10) and a hinge (S) of the cupboard door (60) is arranged on the opposite side of the cupboard (10).

11. The laboratory device (1) as claimed in claim 6, characterized in that the cupboard door (60) has a supporting roller (63) for supporting on a base (B).

12. The laboratory device (1) as claimed in claim 1, characterized in that the laboratory bench (20) has an internal storage space (24).

13. The laboratory device (1) as claimed in claim 1, characterized in that the laboratory bench (20) has at least one rim (25) against which, in the second pivoted position (P2), at least one working table (50, 51, 52, 53, 54, 55) can be placed.

14. The laboratory device (1) as claimed in claim 1, characterized in that at least one structure on the laboratory bench (20) is designed such that it can be folded over flat.

15. The laboratory device (1) as claimed in claim 1, characterized in that the cupboard (10) is lockable with a lock (64).

* * * * *